United States Patent [19]

Helms

[11] Patent Number: 4,470,726

[45] Date of Patent: Sep. 11, 1984

[54] LEG CLOSURE

[75] Inventor: Lonnie C. Helms, Duncan, Okla.

[73] Assignee: Halliburton Company, Duncan, Okla.

[21] Appl. No.: 432,601

[22] Filed: Oct. 4, 1982

[51] Int. Cl.[3] ..... E02D 5/52

[52] U.S. Cl. ..... 405/227; 138/89; 428/109; 405/225

[58] Field of Search ..... 405/224–227, 405/195, 204, 205; 156/92, 93, 155, 177; 138/89–94; 220/207; 428/109–112

[56] References Cited

U.S. PATENT DOCUMENTS

| | | | |
|---|---|---|---|
| 1,427,708 | 8/1922 | Williams | 428/109 |
| 1,860,090 | 5/1932 | Fowler | 428/111 |
| 3,533,241 | 10/1970 | Bowerman et al. | 405/227 X |
| 3,644,165 | 2/1972 | Chen | 428/110 |
| 3,788,162 | 1/1974 | Rabenhorst et al. | 156/177 X |
| 4,024,723 | 5/1977 | Mayfield et al. | 405/227 |
| 4,178,112 | 12/1979 | Knox | 405/227 |
| 4,220,422 | 9/1980 | Sullaway | 405/225 |
| 4,230,424 | 10/1980 | Sullaway | 405/225 X |
| 4,367,983 | 1/1983 | Streich | 405/225 X |

*Primary Examiner*—Dennis L. Taylor

*Attorney, Agent, or Firm*—Thomas R. Weaver; James R. Duzan

[57] ABSTRACT

A closure of reinforced elastomeric material having layers or plies of reinforcing means bonded or secured to one or more reinforcing members in the outer periphery of the closure wherein each layer or ply of reinforcing means is comprised of a plurality of strips of fabric, at least one strip of fabric having the ends wrapped and secured about one or more reinforcing members in the outer periphery and covering the center of the closure or diaphragm and the remaining strips of fabric having each end thereof wrapped and secured about one or more reinforcing members in the outer periphery and extending along lines which are chords of a circle formed by a reinforcing member such that the closure of diaphragm has each area thereof reinforced by at least one strip of fabric.

17 Claims, 8 Drawing Figures

LEG CLOSURE

BACKGROUND OF THE INVENTION

This invention relates to an improved closure or diaphragm for offshore platforms used in well drilling and production.

Offshore platforms are generally fabricated in a harbor or on a shore location and are then towed to a marine site where they are tipped on end and lowered into position with the platform resting on the ocean floor. The platform legs are hollow structures having open ends so that pilings can be driven downwardly through the legs into the subterranean formations below the ocean floor to anchor the platform in position.

It is desirable during platform setting operations to utilize the platform legs and/or pile sleeves for buoyancy to assist in the setting operations. It is also desirable to exclude foreign material from the platform leg and/or pile sleeve during platform setting operations to prevent the annulus between the piling and the platform leg and/or pile sleeve from becoming contaminated with foreign material which would prevent the filling of the annulus with cement or grout. Therefore, a closure structure which is easily severable when the piling is driven through the platform leg and/or pile sleeve is used to seal the end of the platform leg and/or pile sleeve during setting of the platform.

Typical prior art closure structures, generally referred to as closures or diaphragms, utilized to seal the end of a platform leg and/or pile sleeve of an offshore platform, are illustrated in U.S. Pat. Nos. 3,533,241, 4,024,723, 4,178,112, 4,220,422 and 4,230,424. While these closures are generally satisfactory, all utilize layers or plies of reinforcing material comprised of unitary pieces of fabric to reinforce the closure.

Another prior art closure or diaphragm shown in U.S. patent application Ser. No. 221,125, filed Dec. 29, 1980, to Streich, assigned to the assignee of the present invention, utilizes layers or plies of reinforcing material comprised of strips of fabric where each strip is oriented with respect to another strip in the same layer or ply and with another in an adjacent layer or ply such that the number of longitudinal threads of the fabric of the strips of each layer or ply generally extend along radial lines in a horizontal plane of the closure.

SUMMARY OF THE INVENTION

When installed on the jacket leg and/or pile sleeve of an offshore platform, during platform setting or installation operations, a closure is deformed into a generally hemispherical shape due to the hydrostatic loading of the closure by the water. Since a closure is reinforced by unitary layers or plies of either woven fabric having longitudinal (warp) threads and fill (weft) threads at right angles thereto or fabric having essentially longitudinal (warp) threads only retained in a matrix of elastomeric material, i.e., calendared with a rubber coating, when hydrostatically loaded, the layers or plies of fabric are also deformed into a generally hemispherical shape. Since some of the threads of such fabrics will lie along lines other than radial lines of a horizontal plane of the closure, it is apparent that the loading of the closure will not be evenly distributed about each layer or ply of fabric.

Therefore, ideally, to uniformly distribute the load throughout each layer or ply of fabric when the closure is subjected to hydrostatic loading which will tend to deform the closure into a hemispherical shape, each layer or ply of fabric should be comprised of threads which will have a radial orientation in a horizontal plane of the closure.

In some prior art closures, attempts to obtain radial orientation of the threads of the fabrics were made by angularly rotating each layer or ply of fabric with respect to each other in the closure. The degree of angular rotation of each layer or ply of fabric with respect to another being determined by dividing the total number of layers or plies of fabric in the closure or diaphragm into 180 degrees.

In other prior art closures attempts to obtain radial orientation of the threads of fabrics were made by having layers or plies of reinforcing means bonded or secured to one or more reinforcing members in the outer periphery of the closure wherein each layer or ply of reinforcing means is comprised of a plurality of strips of fabric, each strip being angularly located with respect to another in the same layer or ply and with respect to another in an adjacent layer or ply such that the number of longitudinal threads of the fabric of the strips of each layer or ply generally extending along radial lines of a horizontal plane of the closure.

Another important consideration in uniformly distributing the load throughout each layer or ply of fabric of a diaphragm when the diaphragm is hydrostatically loaded is the control of the amount of stretching of the longitudinal threads comprising the fabric of the diaphragm. Since the threads comprising the fabric stretch during loading and only exhibit a relatively constant strength over a range of thread elongation, if the amount of stretching of the fabric threads can be controlled to be within the range in which the thread exhibits a relatively constant strength, the strength of the diaphragm and the manner in which the diaphragm fails due to excessive loading may be controlled.

If a diaphragm does not have the threads of the fabric of the reinforcing material along radial lines of a horizontal plane of the closure, the loading of the closure is not evenly distributed about each layer or ply of fabric and the threads of the fabric will not all uniformly stretch. Similarly, if it is attempted to place the longitudinal threads of the fabric of the strips of fabric comprising each layer or ply of a diaphragm along radial lines, due to the large number of strips of fabric overlying each other in the center of the diaphragm for diaphragms having a large number of layers or plies, upon loading of the diaphragm, since some strips of fabric are longer than others and the elastomeric material of the diaphragm allows limited relative movement of the strips with respect to each other, all threads of the fabric will still not stretch uniformly by the hydrostatic loading of the diaphragm.

In contrast to the prior art closures or diaphragm, the closure or diaphragm of the present invention comprises a closure of reinforced elastomeric material having layers or plies of reinforcing means bonded or secured to one or more reinforcing members in the outer periphery of the closure wherein each layer or ply of reinforcing means is comprised of a plurality of strips of fabric, at least one strip of fabric having the ends wrapped and secured about one or more reinforcing members in the outer periphery and covering the center of the closure or diaphragm and the remaining strips of fabric having each end thereof wrapped and secured about one or more reinforcing members in the outer periphery and extending along lines which are chords of a circle formed by a reinforcing member such that the closure or diaphragm has each area thereof reinforced by at least one strip of fabric.

BRIEF DESCRIPTION OF THE DRAWINGS

The advantages of the preferred embodiment of the present invention will be more fully understood from the following specification taken in conjunction with the accompanying drawings wherein.

DESCRIPTION OF THE INVENTION

Figure 1:
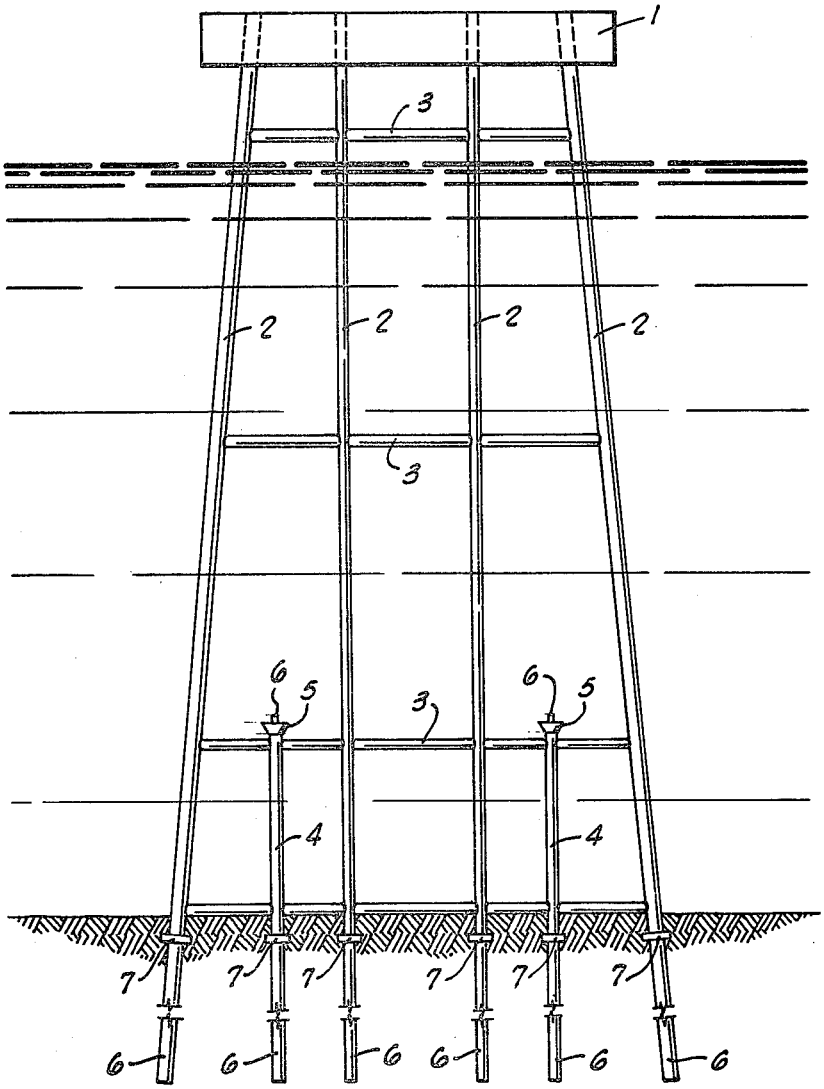
FIG. 1 is a side elevational view of a marine platform having tubular supporting legs and piling guide sleeves between the legs resting on the bottom of a body of water with the present invention installed on the lower end of the legs and sleeves.

Referring to FIG. 1, the present invention is shown installed on a marine platform. A marine platform 1 is shown having tubular supporting legs 2 between which horizontal reinforcing members 3 are connected in the usual manner. Tubular piling guide sleeves 4, which may have flared upper ends 5, are supported between the lower end portion of the legs 2 by the lower reinforcing members 3 and, with the legs, are adapted to rest upon or have their lower extremities embedded in the bottom of a body of water.

The sleeves 4 and legs 2 are secured to the earth by driving a piling 6 to refusal or to a predetermined depth into the bottom of the body of water. Upon completion of the pile driving, the annulus between each sleeve 4 and/or leg 2 and its associated piling 6 may be filled with cement or grout to provide a unitary base structure.

Contained on the bottom of each leg 2 and guide 4 is a rupturable seal assembly 7 which embodies the principles of the present invention.

Figure 2:
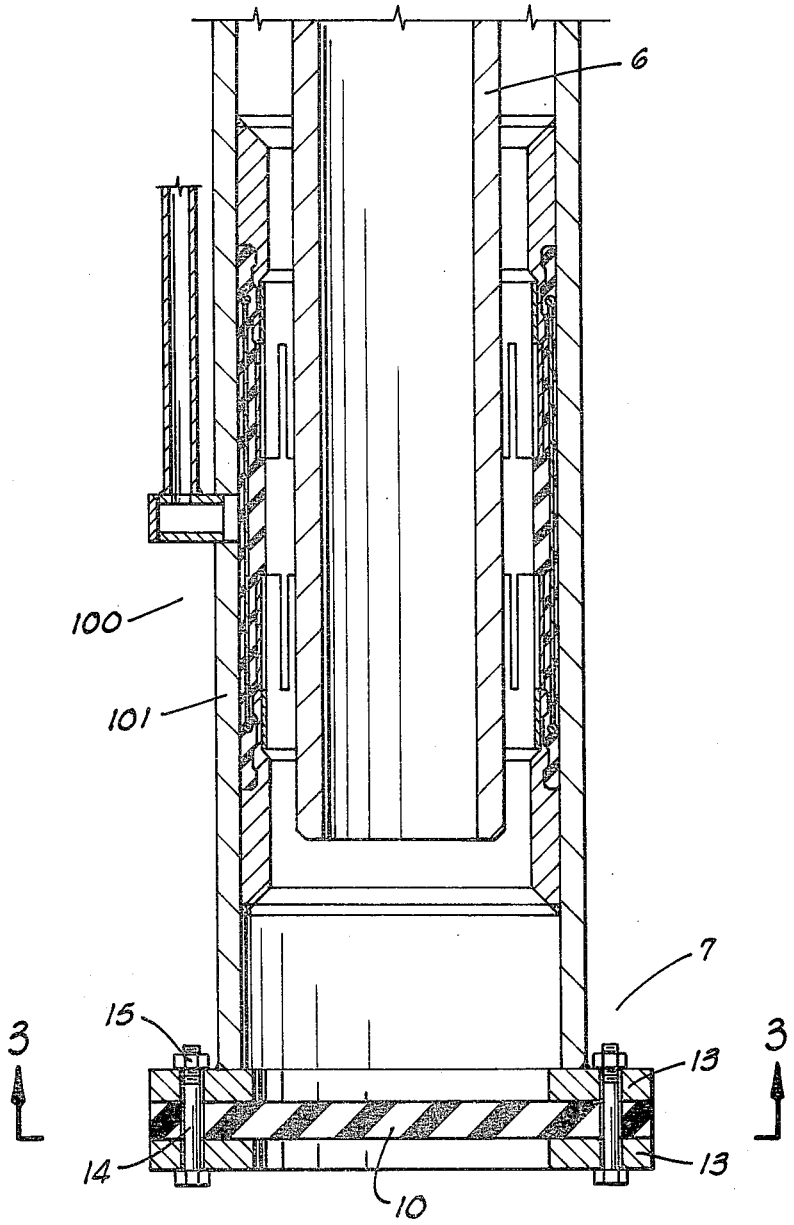
FIG. 2 is a cross-sectional view of the present invention in a typical installation in a leg or piling guide sleeve.

Referring to FIG. 2, the seal assembly 7 is shown in relation to an inflatable packer assembly 100 installed at the bottom of a leg 2 or guide sleeve 4. As shown, the closure or diaphragm 10 is relatively thin compared to its diameter.

For mounting the seal assembly 7 on the lower end of the inflatable packer assembly 100, a pair of flat annular plates 13 is provided with the plates 13 being adapted to be releasably secured to each other about their outer periphery by a plurality of bolts 14 and nuts 15. The bolts 14 also extending through the outer periphery of the closure or diaphragm 10 having annular metal reinforcing members 12 therein (not shown). The upper annular plate 13 is adapted to be secured to the lower end of the packer housing 101 by welding, although any suitable means of securing the plate 13 may be used. If no inflatable packer is installed on the bottom of the leg 2 or guide sleeve 4, alternatively, the plate 13 may be secured to the bottom of leg 2 or guide sleeve 4.

As shown, the seal assembly closes the lower end of the inflatable packer assembly 100 which is secured to a leg 2 or guide sleeve 4 through which a piling is to be driven to facilitate floating of the platform to its point of installation, as well as preventing the entrance of silt and other debris into the leg 2 or guide sleeve 4 during the installation of the platform. To position the platform legs 2 and guide sleeves 4 on the bottom of the body of water, it is necessary to waterflood some or all of the legs 2 or guide sleeves 4. After rupturing of the closure or diaphragm 10 by the piling 6 being driven into the bottom, the closure or diaphragm 10 and the water located thereabove acts to help prevent entry of foreign material into the leg 2 or guide sleeve 4, although during driving of the piling 6, an amount of foreign material will be introduced into the leg 2 or guide sleeve 4.

Although not shown, the closure or diaphragm 10 may be secured to the jacket leg or pile sleeve of the platform by means of two annular plates having flat confronting faces with inwardly tapered enlarged ends to retain the closure or diaphragm therebetween by means of an interference fit therewith.

Figure 3:
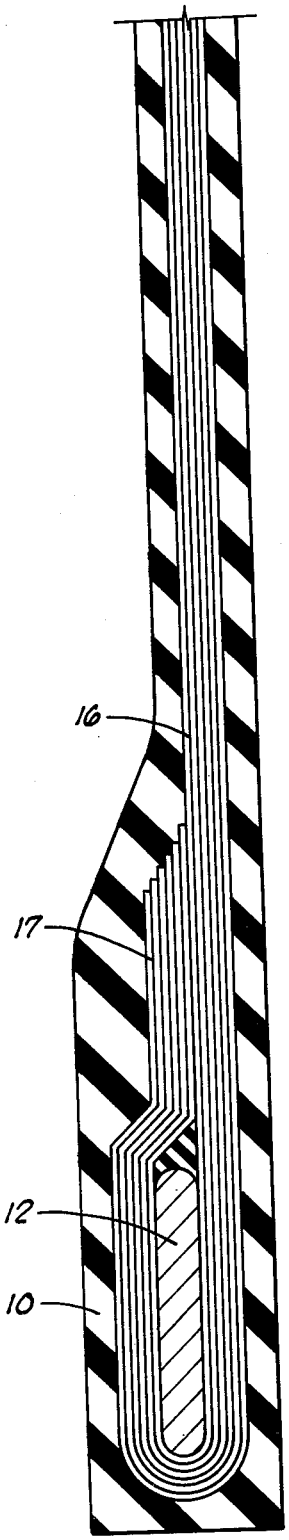
FIG. 3 is a cross-sectional view of a portion of the present invention.

Referring to FIG. 3, a cross-sectional view of a portion of a schematic embodiment of the present invention is shown. The closure or diaphragm 10 comprises a flexible member of rubber, synthetic rubber or other suitable elastomeric material. To reinforce the closure 10, a plurality of strips 16 of fabric are bonded or secured within the closure 10 with the outer periphery of the strips 16 of fabric being wrapped about and bonded or secured to one or more annular metal reinforcing members 12 with the ends 17 of the strips 16 of fabric extending into the inner portion of the closure 10. Any number of strips 16 of fabric may be used to reinforce the closure 10 depending upon the desired strength of the closure. The strips 16 of fabric used to reinforce the closure 10 may be of any suitable material, such as rayon, nylon, polyester, steel, a fabric sold under the trademark Kevlar by the DuPont Company, although polyester fabric is preferred. Although not shown in this drawing figure, when the closure 10 is installed on a jacket leg 2 or pile sleeve 4 as shown in FIG. 2, holes extend through the outer periphery of the closure passing through the elastomeric material, the annular metal reinforcing member 12 and the strips 16 wrapped and secured about the member 12.

The annular metal reinforcing member of members 12 may be of any suitable material, although steel is preferred.

Figure 4:
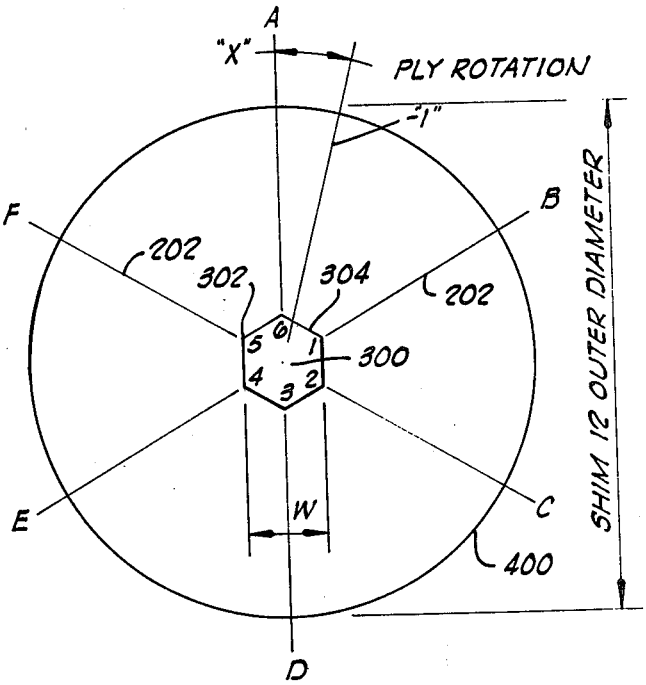
FIG. 4 is a top elevational view of a portion of the table upon which the present invention is laid-up utilizing three strips of fabric across the center of the closure or diaphragm.

Referring to FIG. 4, the table 200 upon which the closure 10 is to be laid-up is shown. A circle 400 which represents the outer diameter of the annular metal reinforcing member 12 used in the closure 10 is marked on the table 200. Since the closure 10 of the present embodiment of the current invention is based upon three strips 16 of fabric reinforcing the center of the closure 10, the geometric shape 300 about which the strips 16 of fabric will be laid-up is a hexagonal shape. This hexagonal shape occurs because the three strips of fabric covering the center of the closure, each strip having two edges, extend along evenly spaced radial lines of the circle 400 and intersect in the center of such a circle. The evenly radially spaced intersection points on the circle 400 of the three strips 16 of fabric of all of which lie in a common horizontal plane of a layer or ply of the closure 10, and are marked as A, B, C, D, E and F on the table 200. The width "W" of the hexagon is determined by the width of the strip of fabric to be used. The intersection points 302 of the sides 304 of the hexagon 300 are marked in the manner shown having numerals 1 through 6. Lines 202 are also marked on the table 200 in the manner shown such that line A-D passes through intersection points 302 marked "6" and "3" on the hexagon 300 while line B-E passes through intersection points 302 marked "1" and "4" and line C-F passes through intersection points 302 marked "2" and "5". As shown, the center of the hexagon 300 and circle 400 coincide. Also shown in FIG. 4, a line "Y" which is displaced angle "X" degrees from line A-D about the circle 400 is marked on the table 200. The line "Y" represents the amount of ply or layer rotation for each ply or layer of strips of fabric forming the closure 10. The amount of displacement of the line "Y" from line A-D in degrees is determined by dividing the amount of angular displacement in degrees of line A-D with respect to line B-E by the number of plies or layers of strips 16 of fabric in the closure 10. For example, assuming line B-E is displaced sixty (60) degrees from line A-D and there are to be six (6) plies in the closure 10 the angle "X" would be ten (10) degrees. If desired, the angle "X" may be expressed in inches of circumference around circle 400.

Figure 5:
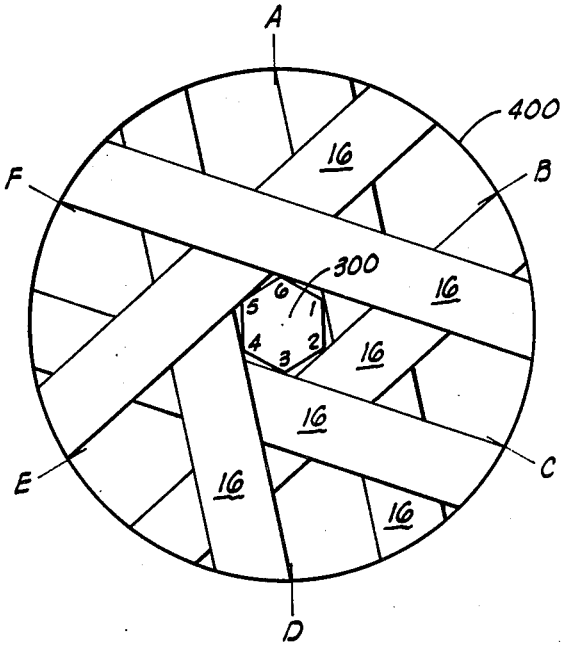
FIG. 5 is a top elevational view of the first step in laying-up the reinforcing strips of fabric of the present invention.

Referring to FIG. 5, the first step of the lay-up procedure to form a ply or layer of strips 16 of fabric wrapped about annular metal reinforcing member 12 is shown. As shown, in the first step of the lay-up procedure six (6) strips 16 are laid-up to be wrapped about the annular metal reinforcing means 12. A first strip 16 is positioned on the table 200 having one of its edges, the inner edge, extending along a line running from point "A", through the intersection of sides 304 numbered "1" of the hexagon 300 to the opposite portion of the circle 400 from point "A". A second strip 16 is positioned having its inner edge extending along a line running from point "B", through the intersection of sides 304 numbered "2" of the hexagon 300, to the opposite portion of the circle 400 from point "B". A third strip 16 is positioned having its inner edge extending along a line running from point "C", through the intersection of sides 304 numbered "3" of the hexagon 300, to the opposite portion of the circle 400 from point "C". A fourth strip 16 is positioned having its inner edge extending along a line running from point "D", through the intersection of sides 304 numbered "4" of the hexagon 300, to the opposite portion of the circle 400 from point "D". A fifth strip 16 is positioned having its inner edge extending along a line running from point "E", through the intersection of sides 304 numbered "5" of hexagon 300, to the opposite portion of the circle 400 from point "E". A sixth strip 16 is positioned having its inner edge extending along a line running from point "F", through the intersection of sides 304 numbered "6" of hexagon 300, to the opposite portion of the circle 400 from point "F". It should be understood that lines A-1, B-2, C-3, D-4, E-5 and F-6 are chords of circle 400, which represents the outer diameter of annular metal reinforcing member 12.

Figure 6:
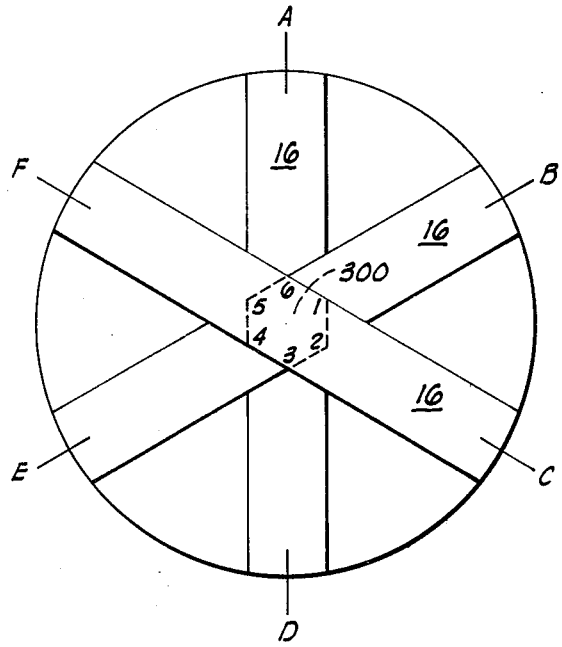
FIG. 6 is a top elevational view of the second step in laying-up the reinforcing strips of fabric of the present invention.

Referring to FIG. 6, the second step of the lay-up procedure to form a ply or layer of strips 16 of fabric wrapped about annular metal reinforcing member 12 is shown. As shown, in the second step of the lay-up procedure three (3) strips 16 are laid-up to be wrapped about the annular metal reinforcing means 12. The first strip 16 is positioned on the table 200 overlaying the strips 16 shown in FIG. 5 and is centered about a line extending from points "A" to "D". A second strip 16 is positioned and is centered about a line extending from points "B" to "E". A third strip 16 is positioned and is centered about a line extending from points "C" to "F". It should be noted that the points where the strips 16 of fabric intersect or overlie form the intersection points or vertices 302, numbered 1, 2, 3, 4, 5 and 6, of the hexagon 300 while the edge of the strips 16 form the sides 302 thereof. It should be evident that, in this instance, the width of the strips 16 of fabric is equal to the width "W" of the hexagon 300.

Figure 7:
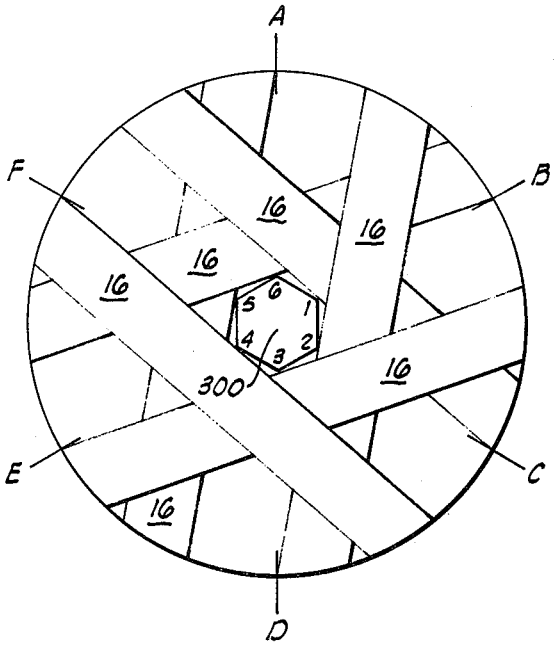
FIG. 7 is a top elevational view of the third step in laying-up the reinforcing strips of fabric of the present invention.

Referring to FIG. 7, the third step of the lay-up procedure to form a ply or layer of strips 16 of fabric wrapped about annular metal reinforcing member 12 is shown. As shown, in the third step of the lay-up procedure six (6) strips 16 are laid-up to be wrapped about the annular metal reinforcing means 12. A first strip 16 is positioned on the table 200 overlaying the strips 16 shown in FIGS. 5 and 6 having its inner edge extending along a line running from point "A", through the intersection of sides 304 numbered "5" of hexagon 300, to the opposite portion of the circle 400 from point "A". A second strip 16 is positioned having its inner edge extending along a line running from point "B", through the intersection of sides 304 numbered "6" of the hexagon 300, to the opposite portion of the circle 400 from point "B". A third strip 16 is positioned having its inner edge extending along a line running from point "C", through the intersection of sides 304 numbered "1" of the hexagon 300, to the opposite portion of the circle 400 from point "C". A fourth strip 16 is positioned having its inner edge extending along a line running from point "D", through the intersection of sides 304 numbered "2" of the hexagon 300 to the opposite portion of the circle 400 from point "D". A fifth strip 16 is positioned having its inner edge extending along a line running from point "E", through the intersection of sides 304 marked "3" of hexagon 300, to the opposite portion of the circle 400 from point "E". A sixth strip 16 is positioned having its inner edge extending along a line running from point "F", through the intersection of sides 304 numbered "4" of hexagon 300, to the opposite portion of the circle 400 from point "F". As before it should be understood that lines A-5, B-6, C-1, D-2, E-3 and F-4 are chords of circle 400, which represents the outer diameter of annular metal reinforcing member 12.

Referring to FIGS. 5 through 7, the three steps of the above lay-up procedure may be summarized in the following Table I:

TABLE I

| LAY-UP PROCEDURE | | |
|---|---|---|
| Step I<br>Strip to have inner edge along line drawn between the following points | Step II<br>Strip to be centered about line drawn between following points | Step III<br>Strip to have inner edge along line drawn between the following points |
| A-1 | A-D | A-5 |
| B-2 | B-E | B-6 |
| C-3 | C-F | C-1 |

TABLE I-continued

| LAY-UP PROCEDURE | | |
|---|---|---|
| Step I<br>Strip to have inner edge along line drawn between the following points | Step II<br>Strip to be centered about line drawn between following points | Step III<br>Strip to have inner edge along line drawn between the following points |
| D-4 | | D-2 |
| E-5 | | E-3 |
| F-6 | | F-4 |

It should be understood that in this example, each layer or ply of the closure 10 is comprised of fifteen (15) of the strips 16 of fabric oriented as shown in FIGS. 5 through 7. If strip orientations shown in FIGS. 5 through 7 are superimposed on one another, it should be evident that the entire portion of the interior of the annular metal reinforcing means 12 is covered by at least one strip 16 of fabric as the intersection points of the various strips 16 at or near the circle 400, which represents the outer diameter of the annular metal reinforcing member 12, are to either be on the circle 400 or not be inside a circle (not shown) representing the inner diameter of the member 12.

It should also be understood that although the strips 16 which extend along the radial lines (Step II) of circle 400 are laid-up between the strips 16 which extend along lines which are chords of the circle 400 (Steps I and III), the strips 16 which extend along radial lines could be laid-up after the strips of Step I or before the strips of Step III.

When the fifteen (15) strips 16 of fabric are laid-up on the table 200, the annular metal reinforcing member 12 is then laid on the strips 16 and the ends 17 of the strips 16, which ends extend beyond circle 400 on table 200, are wrapped about member 12 and wrapped to extend into the inner portion of the closure 10. After wrapping the strips 16 about member 12, the partially completed closure 10 has position A marked thereon and is removed from table 200 so that the next ply or layer of 15 strips 16 of fabric can be laid-up on table 200.

After the next ply of strips 16 have been laid-up on table 200 according to the procedure and orientation set forth above in the specification and Table I, the partially completed closure 10 is returned to the table 200, position "A" which was marked on the previous ply or layer of strips 16 is placed at position "Y" on circle 400 and the subsequent layer or ply comprised of strips 16 on table 200 is then wrapped about the partially completed closure. After this ply of strips 16 has been wrapped about the partially completed closure 10, the position "A" is again marked on the partially completed closure 10 and the closure removed from the table 200 for the next ply of strips to be laid-up on the table 200. This procedure is repeated until the desired number of layers or plies have been laid-up to form the closure 10.

It should be understood that the strips 16 of fabric used to form the closure 10 are covered with a coating of rubber or "calendared" and are coated with any suitable commercially available bonding agent.

Although the above example of constructing a closure or diaphragm 10 was based upon an arrangement of strips 16 of fabric wherein the center of the closure 10 was comprised of or covered by three strips 16, the construction arrangement can be set forth as a general case so that any number of strips 16 covering the middle of the closure 10 may be utilized.

Figure 8:
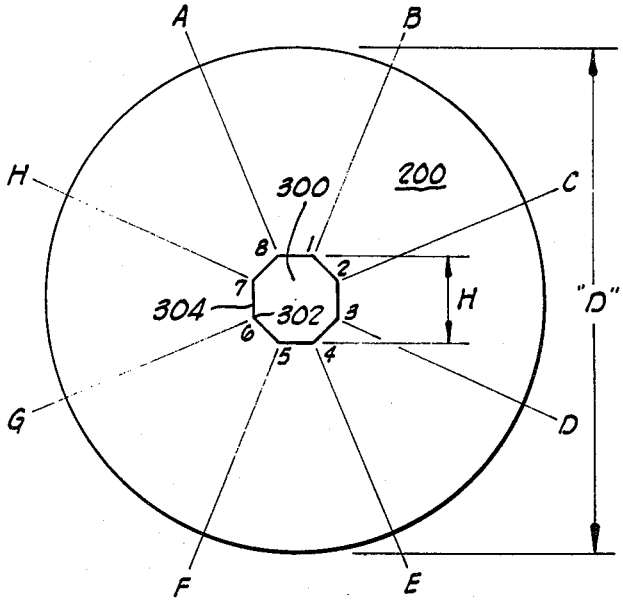
FIG. 8 is a top elevational view of the table upon which the present invention is laid-up utilizing four reinforcing strips of fabric across the center of the closure or diaphragm.

Referring to FIG. 8, a table 200 having marks thereon for an arrangement having four strips 16 of fabric covering the center of the closure 10 is shown.

Before discussing the arrangement or lay-up of strips 16 of fabric for a closure 10 having four strips 16 covering the center, it should be realized that a closure may be constructed having any number of strips 16 covering the center of the closure according to the general equation:

$$H = \sin\beta(D \sin\alpha - 2W)$$

where

H = width or height of central geometric figure about which strips of fabric are positioned i = number of strips of fabric across the middle or center of the closure D = outside or outer diameter of the annular metal reinforcing means $$\alpha = \frac{180 - \frac{360}{i}}{2}$$

or ½ of the exterior angle of a closed central polygon shape having its number of sides equal to the number of strips covering the center portion of the closure.

$$\beta = \frac{180 - \frac{360}{2i}}{2}$$

or ½ of the exterior angle of a closed central polygon shape having its number of sides equal to twice the number of strips covering the center portion of the closure.

For the case where H, the width "W" or height of the central geometric figure about which strips of fabric are positioned, is equal to the width of the strips of fabric used to reinforce the closure, the general equation given above becomes:

$$H = \frac{D \sin\beta \sin\alpha}{1 + 2\sin\beta}$$

It should be understood or realized that based on the above equations the smallest number of strips 16 of fabric which cover the center of the closure 10 is three (3). This would result in a geometric shape of a hexagon about which the strips would be oriented in forming the plies or layers of strips of fabric. If it is desired to have four strips of fabric to cover the center of the closure 10, an octagonal geometric shape would be used about which the strips would be oriented to form the plies or layers. In each instance, the geometric shape about which the strips are oriented to form each ply or layer is a regular geometric shape having twice the number of sides as the number of strips of fabric covering the center of closure.

It should also be realized that the same procedure for orienting the strips of fabric about the geometric shape in the center of the closure for four strips thereacross is similar to that set forth in the above example wherein three strips were utilized to cover the center of the closure. For instance, for the example shown in FIG. 8 wherein four (4) strips are covering the center of the closure with an octagonal geometric shape being used to orient the strips the lay-up procedure would be as follows in Table II:

TABLE II

| LAY-UP PROCEDURE | | |
|---|---|---|
| Step I Strip to have inner edge along line drawn between following points | Step II Strip to be centered about line drawn between following points | Step III Strip to have inner edge along line drawn between the following points |
| A-1 | A-E | A-7 |
| B-2 | B-F | B-8 |
| C-3 | C-G | C-1 |
| D-4 | D-H | D-2 |
| E-5 | | E-3 |
| F-6 | | F-4 |
| G-7 | | G-5 |
| H-8 | | H-6 |

Referring again to the general equation and the term definitions therefore it should be evident that for the situations where it is desired to have only one or two strips 16 of fabric cover the center of the closure 10 there is no defined geometric width W or height H for a central geometric figure about which strips of fabric are to be positioned. This result occurs because of the definitions for $\alpha$ and $\beta$ and the fact a closed polygon can only be formed with a minimum of three sides.

However, a closure 10 may still be laid-up having only one or two strips 16 cover the center of the closure by using the procedure for laying up strips 16 around a square, a regular hexagon or any other desired closed regular polygon. In this instance or case, any desired height "H" or width "W" for the central closed polygon is chosen. However, the height "H" of width "W" of the central closed polygon should be selected so as to allow the central portion of the closure 10 which is bounded by the closed central polygon about which strips 16 of fabric are to be positioned to have sufficient strength to bear the anticipated loading thereon, although it is to be reinforced solely by the one or two strips 16 of fabric which will extend thereacross.

A proposed layup procedure for a closure 10 having only one (1) strip 16 of fabric covering the central geometric polygon could be the same as that set forth in Table I except in Step II there would be only one (1) strip of fabric, rather than three (3). Similarly, for two (2) strips 16 of fabric covering the central geometric polygon the layup procedure could be the same as that set forth in Table I except in Step II there would be only (2) strips of fabric, rather than three (3).

Although the proposed layup procedure for a closure having one (1) or two (2) strips of fabric has been illustrated using a regular hexagon as the central geometric polygon, it could utilize a square, a regular octagonal central polygon or any other regular polygon as the geometric shape about which strips of fabric are laidup.

Referring to FIGS. 5 through 8, it should be recognized that a closure 10 constructed or fabricated by arranging the strips 16 of fabric therein according to the method and geometric arrangement described hereinbefore will have the greatest number of the intersection points or positions where the various strips 16 of fabric cross or overlay each other in an area which is bounded in the inner portion of the diaphragm by the geometric shape about which the strips 16 of fabric in each layer or ply, except for the strips 16 covering the center, are laid-up and the inner diameter of the annular metal reinforcing means 12 used to reinforce the outer portion of the closure 10. It should further be recognized that by having the greatest number of the intersection points or positions where the various strips of fabric cross or overlay each other in the above described area rather than being concentrated in generally the center portion of the closure a more uniform thickness in the distribution of the strips 16 of fabric results in the closure. By having a more uniform distribution of the strips 16 of fabric in the closure when subjected to hydrostatic loading by water or fluid the strips 16 of the fabric will tend to be stretched more uniformly than a closure having the various of strips 16 of fabric cross or overlay each other in generally the center portion of the closure.

It should further be realized that if the width of the strips 16 of fabric is not large in relation to the diameter of the closure 10, since many of the strips 16 of fabric lie along similar length geometric chords of the closure, during hydrostatic loading of the closure by water or fluid, the threads comprising the strips 16 of fabric will tend to stretch uniformly.

It should be evident from the foregoing that the closure 10 of the present invention offers advantages over the prior art closures.

By distributing the intersection points or positions where the strips of fabric cross or overlay each other in the area between the central geometric shape about which the strips of fabric in each layer or ply, except for the strips covering the center, are laid-up and the inner diameter of the annular metal reinforcing means a more uniform thickness in the distribution of the strips of fabric results, hence, a more uniform stretching of the threads of the strips occur when subjected to hydrostatic loading.

By utilizing strips of fabric to form each ply or layer used to reinforce the closure the cost of fabric is reduced for the closure in comparison to a closure having unitary layers of fabric therein because the strips of fabric can be formed from narrow pieces of fabric which are less expensive than large unitary pieces of fabric.

The closure is easily constructed using simple wrapping of the layers of fabric reinforcing the closure around the reinforcing members in the outer periphery of the closure.

The annular flat plates retaining the closure have simple shapes requiring little machining for use.

The closure is positively retained between the annular flat plates to prevent release therefrom.

The reinforcing members in the periphery of the closure are simple geometric shapes which can be easily constructed.

The closure can be used with a variety of types of annular flat plates to retain the closure on the leg or guide sleeve of an offshore platform.

Having thus described my invention, I claim:

1. In combination, a closure and an annular closure retaining means retaining said closure therein for closing the bore of a tubular support member of a marine platform located in a body of water or other similar structure located in a fluid environment, wherein said closure comprises:

circular flexible member means having a peripheral portion and an inner portion;

annular reinforcing member means located in the peripheral portion of the circular flexible member means; and reinforcing means having a peripheral portion and an inner portion contained within the circular flexible member means, the reinforcing means comprising at least one layer of reinforcing means, each layer of reinforcing means comprising a plurality of strips of fabric means, at least one strip of fabric means covering the center of said closure and the remaining strips of fabric means extending along lines which are chords of a circle formed by an annular reinforcing member means in the peripheral portion of the circular flexible member means, each strip of fabric having the ends thereof wrapped and secured about the annular reinforcing member means in the peripheral portion of the circular flexible member means.

2. The combination of claim 1 wherein the lines which are chords of a circle formed by the annular reinforcing member means along which the remaining strips of the fabric means extend are defined by a point on the circle and the point of intersection of two sides of a polygon whose center coincides with the center of the circle.

3. The combination of claim 1 wherein a plurality of strips of the fabric means of the reinforcing means cover the center of said closure and the remaining strips of the fabric means extend along lines which are chords of a circle formed by an annular reinforcing member means in the peripheral portion of the circular flexible member means.

4. The combination of claim 1 wherein a plurality of strips of the fabric means of the plurality of strips of the fabric means of the reinforcing means cover the center of said closure, the intersection points of the strips forming the vertices of a polygon while the edges of the strips form the sides thereof, and the remaining strips of the plurality of strips of the reinforcing means extend along lines which are chords of a circle formed by the annular reinforcing member means, the lines being defined by points on the circle and the intersection points of the strips forming the vertices of a polygon.

5. The combination of claim 4 wherein the plurality of strips covering the center of said closure are equally radially spaced with respect to each other in a plane which extends through the layer of reinforcing means, the intersection points of the strips thereby forming the vertices of a regular polygon while the edges of the strips form the sides thereof.

6. The combination of claim 5 wherein the plurality of strips covering the center of said closure are equally radially spaced with respect to each other, each strip of the plurality of strips covering the center of said closure being centered about a radial line of the circle formed by the annular reinforcing member means and the remaining strips of the plurality of strips of the reinforcing means having their inner edges extending along lines which are chords of a circle formed by the annular reinforcing member means, the lines being defined by points on the circle and the intersection points or vertices of the regular polygon formed by the plurality of strips covering the center of said closure.

7. The combination of claim 1 wherein the inner portion of the reinforcing means is disposed within the inner portion of the circular flexible member means and the peripheral portion of the reinforcing means is disposed within the peripheral portion of the circular flexible member means being wrapped and secured to the annular reinforcing member means having the peripheral portion terminating inwardly of the reinforcing member means and the inner diameter of said annular closure retaining means wherein a portion of the peripheral portion of the reinforcing means overlays a portion of the inner portion of the reinforcing means.

8. The combination of claim 7 wherein:

the annular reinforcing member means having a substantially rectangular cross-sectional shape; and the reinforcing means comprising a plurality of layers of fabric.

9. The combination of claim 8 wherein:

said closure is retained by said annular closure retaining means by means of a plurality of fasteners extending through said annular closure retaining means, through the circular flexible member means of said closure, through the annular reinforcing means of said closure and through the reinforcing means of said closure.

10. In combination, a closure and an annular closure retaining means retaining said closure therein for closing the bore of a tubular support member of an offshore platform located in a body of water or other similar structure located in a fluid environment, wherein said closure comprises:

circular flexible member means having a peripheral portion and an inner portion;

annular reinforcing member means located in the peripheral portion of the circular flexible member means; and reinforcing means having a peripheral portion and an inner portion contained within the circular flexible member means, the reinforcing means comprising at least one layer of reinforcing means, each layer of reinforcing means comprising a plurality of strips of fabric means, at least one strip of fabric means covering the center of said closure and the remaining strips of fabric means extending along lines which are chords of a circle formed by an annular reinforcing member means in the peripheral portion of the circular flexible member means, each strip of fabric having the ends thereof wrapped and secured about the annular reinforcing member means in the peripheral portion of the circular flexible member means; and wherein said annular closure retaining means comprises:

a pair of annular flat plates releasably secured to each other retaining said closure therebetween, said annular closure retaining means having one of the pair of annular plates secured to the end of a tubular support member of said offshore platform or said similar structure thereby closing said bore of the tubular support member by said closure and said closure retaining means being installed thereon.

11. The combination of claim 10 wherein the lines which are chords of a circle formed by the annular reinforcing member means along which the remaining strips of the fabric means extend are defined by a point on the circle and a point of intersection of two sides of a polygon whose center coincides with the center of the circle.

12. The combination of claim 11 wherein a plurality of strips of the fabric means of the reinforcing means cover the center of said closure and the remaining strips of the fabric means extend along lines which are chords of a circle formed by an annular reinforcing member means in the peripheral portion of the circular flexible member means.

13. The combination of claim 12 wherein a plurality of strips of the fabric means of the plurality of strips of the fabric means of the reinforcing means cover the center of said closure, the intersection points of the strips forming the vertices of a polygon while the edges of the strips form the sides thereof, and the remaining strips of the plurality of strips of the reinforcing means extend along lines which are chords of a circle formed by the annular reinforcing member means, the lines being defined by points on the circle and the intersection points of the strips forming the vertices of a polygon.

14. The combination of claim 13 wherein the plurality of strips covering the center of said closure are equally radially spaced with respect to each other in a plane which extends through the layer of reinforcing means, the intersection points of the strips thereby forming the vertices of a regular polygon while the edges of the strips form the sides thereof.

15. The combination of claim 14 wherein the plurality of strips covering the center of said closure are equally radially spaced with respect to each other, each strip of the plurality of strips covering the center of said closure being centered about a radial line of the circle formed by the annular reinforcing member means and the remaining strips of the plurality of strips of the reinforcing means having their inner edges extending along lines which are chords of a circle formed by the annular reinforcing member means, the lines being defined by points on the circle and the intersection points or vertices of the regular polygon formed by the plurality of strips covering the center of said closure.

16. The combination of claim 15 wherein the inner portion of the reinforcing means is disposed within the inner portion of the circular flexible member means and the peripheral portion of the reinforcing means is disposed within the peripheral portion of the circular flexible member means being wrapped and secured to the annular reinforcing member means having the peripheral portion terminating inwardly of the reinforcing member means and the inner diameter of said annular closure retaining means wherein a portion of the peripheral portion of the reinforcing means overlays a portion of the inner portion of the reinforcing means.

17. The combination of claim 16 wherein:

said closure is retained by said annular closure retaining means by means of a plurality of fasteners extending through said closure retaining means, through the circular flexible member means of said closure, through the annular reinforcing means of said closure and through the reinforcing means of said closure.

* * * * *